US009527218B2

(12) United States Patent
Valdez

(10) Patent No.: US 9,527,218 B2
(45) Date of Patent: Dec. 27, 2016

(54) FOLDING KNIFE WITH DUAL OPERATIONAL MODES

(71) Applicant: Mentor Group, L.L.C., Oregon City, OR (US)

(72) Inventor: Brian Valdez, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 174 days.

(21) Appl. No.: 14/426,392

(22) PCT Filed: Aug. 21, 2013

(86) PCT No.: PCT/US2013/055902
§ 371 (c)(1),
(2) Date: Mar. 6, 2015

(87) PCT Pub. No.: WO2014/039255
PCT Pub. Date: Mar. 13, 2014

(65) Prior Publication Data

US 2015/0343650 A1 Dec. 3, 2015

Related U.S. Application Data

(60) Provisional application No. 61/698,655, filed on Sep. 9, 2012, provisional application No. 61/751,839, filed on Jan. 12, 2013, provisional application No. 61/764,168, filed on Feb. 13, 2013.

(51) Int. Cl.
*B26B 1/02* (2006.01)
*B26B 1/04* (2006.01)

(52) U.S. Cl.
CPC *B26B 1/02* (2013.01); *B26B 1/044* (2013.01)

(58) Field of Classification Search
CPC ..... B26B 1/06; B26B 1/04; B26B 1/046; B26B 1/02; B26B 1/048
USPC ..... 30/155, 158–161
See application file for complete search history.

(56) References Cited

U.S. PATENT DOCUMENTS

| | | | |
|---|---|---|---|
| 2,741,841 | A | 4/1956 | Egeth |
| 3,834,022 | A | 9/1974 | Students |
| 4,974,323 | A | 12/1990 | Cassady |
| 5,029,354 | A | 7/1991 | Boyd, Jr. et al. |

(Continued)

FOREIGN PATENT DOCUMENTS

| | | |
|---|---|---|
| FR | 2793182 | 11/2000 |
| FR | 2836854 | 9/2003 |

OTHER PUBLICATIONS

Extended European Search Report for European Patent Application No. 13835103.6, which is a European counterpart of this application.

*Primary Examiner* — Phong Nguyen
(74) *Attorney, Agent, or Firm* — Hancock Hughey LLP

(57) ABSTRACT

A folding knife has dual operational modes. In a first modality, the knife is opened and closed manually. In a second modality, the knife is fully automatic. The user is able to use the knife in either mode, manual or automatic when the blade is in the closed position. In the automatic mode a bolster defines a trigger that causes the blade to move automatically from the closed to the open position. In the manual mode the user manipulates the blade manually to move it from the closed to the open position. A dry fire safety prevents firing of the knife with the trigger when the blade has been opened manually.

20 Claims, 6 Drawing Sheets

(56) References Cited

U.S. PATENT DOCUMENTS

| | | | | |
|---|---|---|---|---|
| 5,044,079 | A | 9/1991 | Gibbs | |
| 5,819,414 | A | 10/1998 | Marifone | |
| 5,915,792 | A | 6/1999 | Sakurai | |
| 5,964,035 | A | 10/1999 | Poehlmann | |
| 6,308,420 | B1 | 10/2001 | Moser | |
| 6,363,615 | B1 | 4/2002 | Moser | |
| 6,574,869 | B1 | 6/2003 | McHenry et al. | |
| 6,651,344 | B2 | 11/2003 | Cheng | |
| 6,675,484 | B2 | 1/2004 | McHenry et al. | |
| 6,732,436 | B2 | 5/2004 | Moizis | |
| 7,086,157 | B2 | 8/2006 | Vallotton | |
| 7,107,686 | B2 | 9/2006 | Linn et al. | |
| 7,243,430 | B1 | 7/2007 | Lerch | |
| 7,278,213 | B2 | 10/2007 | Pardue et al. | |
| 7,293,360 | B2 | 11/2007 | Steigerwalt et al. | |
| 7,296,355 | B2 | 11/2007 | Onion | |
| 7,313,866 | B2 | 1/2008 | Linn et al. | |
| 7,325,312 | B1 | 2/2008 | Janich | |
| 7,380,340 | B1 | 6/2008 | Lerch | |
| 7,437,822 | B2 | 10/2008 | Flagg et al. | |
| 7,603,778 | B1 | 10/2009 | Lerch | |
| 7,627,951 | B2 | 12/2009 | Glesser | |
| 7,676,931 | B2 | 3/2010 | Knight et al. | |
| RE41,259 | E | 4/2010 | McHenry et al. | |
| 7,698,821 | B2 | 4/2010 | Ralph | |
| 7,748,122 | B2 | 7/2010 | Duey | |
| 7,918,028 | B2 | 4/2011 | Steigerwalt et al. | |
| D639,632 | S | 6/2011 | Freeman et al. | |
| 8,046,923 | B2 | 11/2011 | Liu | |
| 8,171,645 | B2 | 5/2012 | Duey | |
| 8,375,590 | B2 | 2/2013 | Duey | |
| 2002/0124415 | A1 | 9/2002 | Mizutani et al. | |
| 2003/0140500 | A1 | 7/2003 | Cheng | |
| 2004/0154170 | A1 | 8/2004 | Kain et al. | |
| 2004/0158991 | A1 | 8/2004 | Freeman | |
| 2004/0261272 | A1 | 12/2004 | Moser | |
| 2005/0223562 | A1* | 10/2005 | Pardue | B26B 1/046 30/161 |
| 2006/0059694 | A1 | 3/2006 | Carter | |
| 2006/0064877 | A1 | 3/2006 | Vallotton | |
| 2007/0137047 | A1 | 6/2007 | Kim | |
| 2007/0169354 | A1 | 7/2007 | Ralph | |
| 2007/0180702 | A1 | 8/2007 | Haw et al. | |
| 2008/0201953 | A1 | 8/2008 | Bremer et al. | |
| 2009/0056146 | A1* | 3/2009 | Duey | B26B 1/048 30/159 |
| 2009/0119926 | A1 | 5/2009 | Nenadic | |
| 2009/0265939 | A1 | 10/2009 | Chu | |
| 2009/0277015 | A1 | 11/2009 | Duey | |
| 2009/0288301 | A1 | 11/2009 | Hawk et al. | |
| 2010/0140059 | A1 | 6/2010 | Kagami et al. | |
| 2011/0099817 | A1* | 5/2011 | Duey | B26B 1/048 30/159 |
| 2011/0162211 | A1 | 7/2011 | Maxey | |
| 2012/0047746 | A1 | 3/2012 | Caswell | |
| 2012/0234142 | A1 | 9/2012 | Onion | |

* cited by examiner

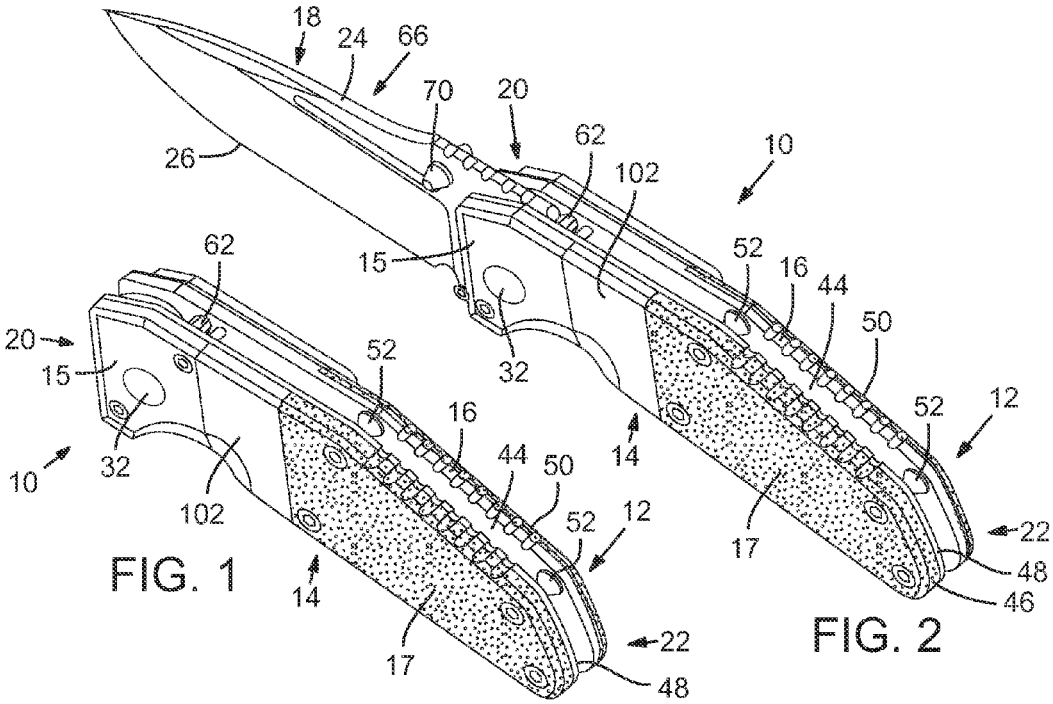
FIG. 1
FIG. 2
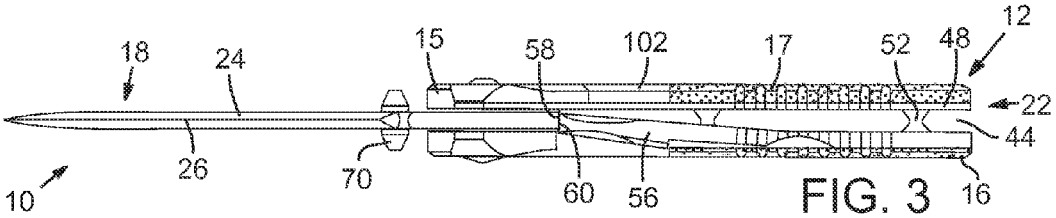
FIG. 3
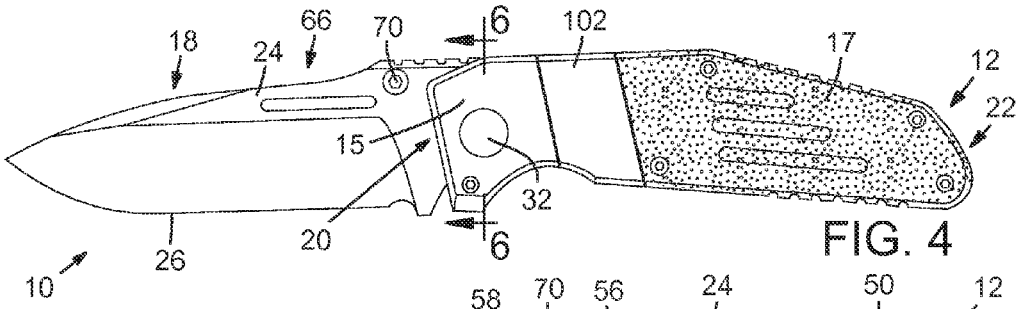
FIG. 4
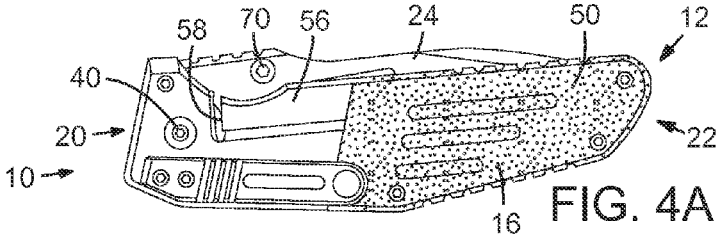
FIG. 4A

FOLDING KNIFE WITH DUAL OPERATIONAL MODES

TECHNICAL FIELD

The present relates to knives, and more particularly, to a folding knife that is capable of operating in dual operational modes at all times, the first being a manual mode in which the blade is movable from the stowed or closed position to the open position, and vice versa, by manual manipulation, and the second being an automatic mode in which the blade is driven from the closed position to the open position automatically under spring force.

BACKGROUND INFORMATION

Folding knives are invaluable tools that are used in many aspects of everyday life, and there are many, many types and styles of folding knives. A "manual" folding knife is a very traditional type of tool in which the knife blade is manually movable by the user between a closed or stowed position in which the sharp edge of the blade is held safely within the handle, and an open position in which the blade is extended in an operable position. Most modern versions of manually operated folding knives include locking mechanisms that lock the blade in the open position—the safety benefits of such locks are obvious. There are innumerable variations on these basic themes.

Automatic folding knifes are nearly as ubiquitous as manual folders. These knives include some type of a mechanism—almost always a spring-driven mechanism—that drives the blade from the closed position toward the open position when the user activates the automatic mechanism, typically by pushing a button or analogous activating mechanism. Generally speaking, in a knife that has an automatic opening mechanism the blade is held in the closed position by a latched trigger mechanism. When the blade is in the closed position the blade is under a constant "pre-load" pressure from a spring mechanism. When the trigger is released, the blade is automatically driven by the spring mechanism into the open position. As with most modern versions of manual knives, most automatic folding knives include locks that lock the blade in the open position. When the user "unlocks" the blade to move it from the open position to the closed position, the rotation of the blade as it is moved reloads the spring mechanism so that the blade is ready to fire again when desired.

Most folding knives, whether manual or automatic, incorporate some kind of a mechanism that holds the blade or working implement in the closed position in which the sharp edge of the blade is held safely within the handle. There are many known mechanisms for retaining blades in the closed position, and there are obvious reasons why such mechanisms are used. Among other reasons, blade-retaining mechanisms prevent unintended opening of the knife and thus promote safety. As noted, most folding knives also include mechanisms that lock the blade in the open position, again, primarily as a safety feature. There are many different types of these locks.

Manual and automatic knives have many uses and can be used in many different settings, and that has led to a demand expressed by many knife users for knives that are operable in dual modes, both automatic and manual. There are benefits to be had in knives that have dual modes of operation and there are a few known dual mode knives. For instance, dual mode knives are described in U.S. Pat. Nos. 7,603,778 and 8,046,923. Nonetheless, there is a continuing need for improved mechanisms for enabling dual operational modes in a folding knife, manual and automatic.

The present invention comprises a folding knife having mechanisms for facilitating dual operational modes. In a first modality, the knife is opened and closed manually. In a second modality, the knife is fully automatic. The user is able to use the knife in either mode, manual or automatic. In the automatic mode a bolster is operable to move a lever in the interior of the knife between first and second positions; the bolster defines a trigger that causes the blade to move automatically from the closed to the open position. The lever in the interior of the knife has one end pivotally attached to one of the handle and its second end resident in a cavity in the bolster, which is slidably movable to move the lever to fire the knife in the automatic mode.

The knife utilizes two torsion springs to drive the blade automatically from closed to open, one spring on each side of the blade and each around the pivot shaft that connects the blade to the handle. The springs are retained in a slotted bushing and drive the blade open when the automatic opening actuator is operated. One end of each spring is fixed to the handle. The opposite ends of the springs interact with the blade—the springs operate on the blade when in auto mode but do not operated on the blade when in the manual mode. The knife further incorporates a dry fire safety mechanism that prevents firing of the automatic opening mechanisms when the blade has been opened manually, and thereby prevents damage to the automatic opening mechanisms.

BRIEF DESCRIPTION OF THE DRAWINGS

The invention will be better understood and its numerous objects and advantages will be apparent by reference to the following detailed description of the invention when taken in conjunction with the following drawings.

FIGS. 1 through 4A show the folding knife according to the present invention in an assembled for and from various perspectives. Specifically, FIG. 1 is a perspective view of the folding knife of the present invention with the blade in the stowed or closed position.

FIG. 2 is a perspective view similar to FIG. 1 but with the blade in the extended or open position.

FIG. 3 is a bottom plan view of the knife shown in FIG. 2.

FIG. 4 is a side elevation view of the knife shown in FIG. 2.

FIG. 4A is a side elevation view of the knife shown in FIG. 1 except illustrating the opposite side of the knife from the view of FIG. 1 and with the knife inverted relative to the orientation of the knife in FIG. 1.

in FIG. 7 the blade is closed and ready to be opened either manually or automatically.

in FIG. 10 the blade is in the open position, having been opened manually.

in FIG. 17A the blade is closed and ready to be opened either automatically or manually.

DETAILED DESCRIPTION OF ILLUSTRATED EMBODIMENTS

A first illustrated embodiment of a folding knife 10 incorporating mechanisms allowing the knife to selectively operate in either a manual or an automatic mode according to the present invention is illustrated in FIGS. 1 through 17. As is detailed herein, the knife 10 is capable of being opened manually or automatically at all times when the blade is in the closed position. In other words, when the blade is in the stowed or closed position, the user may move the blade to the open position either manually or automatically (under spring driven force). The user need not activate any switch to switch the knife from one mode of operation to the other. When the blade has been opened manually and is in the open position the automatic firing mechanism is locked out. This prevents "dry firing" of the automatic opening mechanism to prevent damage to it. When the blade has been opened automatically and is in the open position, rotation of the blade from the open to the closed position rewinds the springs that drive the blade open to reset the firing mechanism. Rewinding of the spring does not occur when the blade has been opened manually and the blade is moved from the open to closed position. The structures that facilitate these functions are detailed herein. But before the switch mechanisms are described in detail, the basic structural features of knife 10 of FIGS. 1 through 17 will be described. Throughout this description, like reference numbers are used to identify like structures found in different embodiments.

Figure 5:
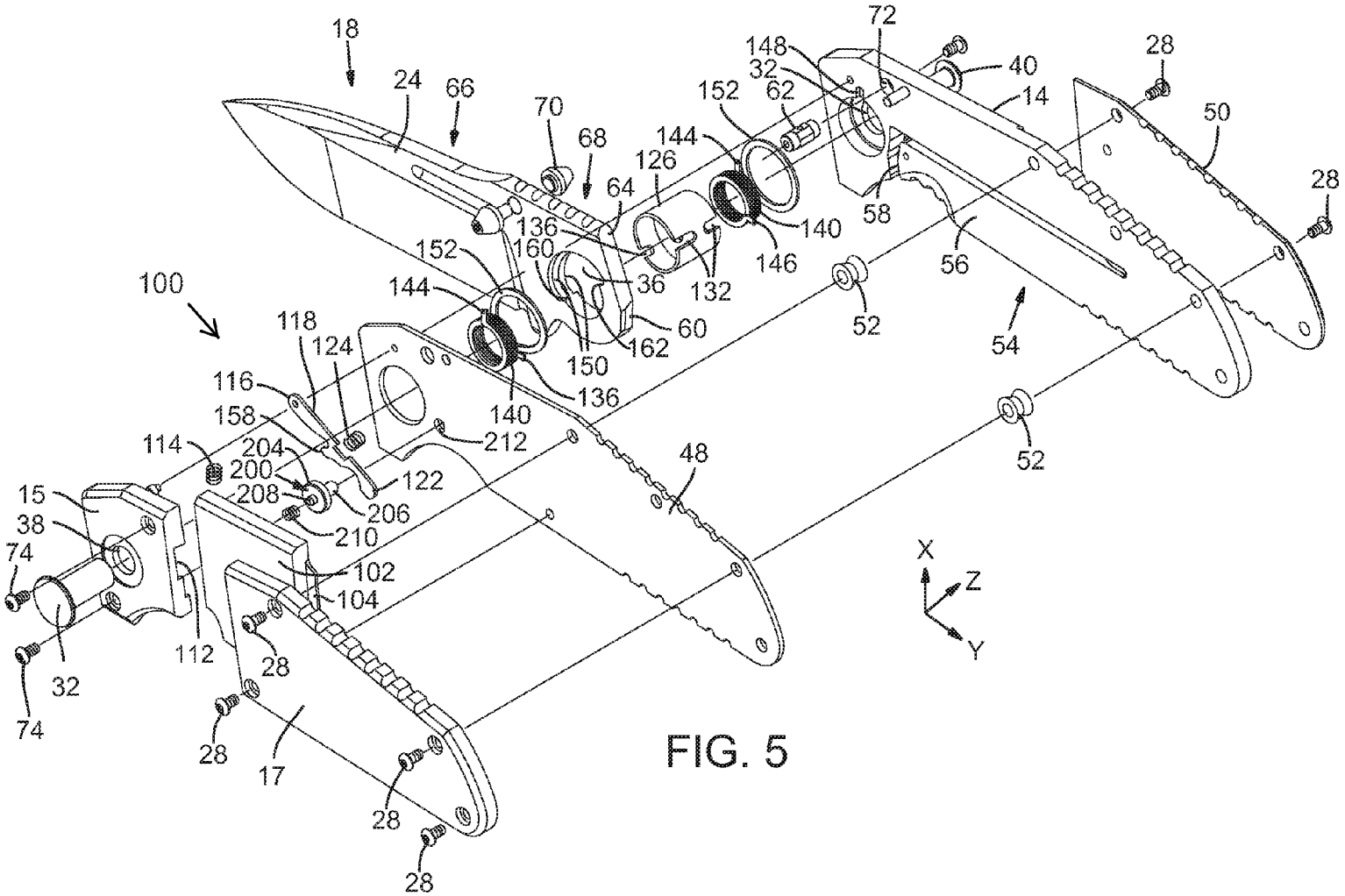
FIG. 5 is an exploded perspective view of the knife shown in FIG. 1 according to the present invention.
Figure 6:
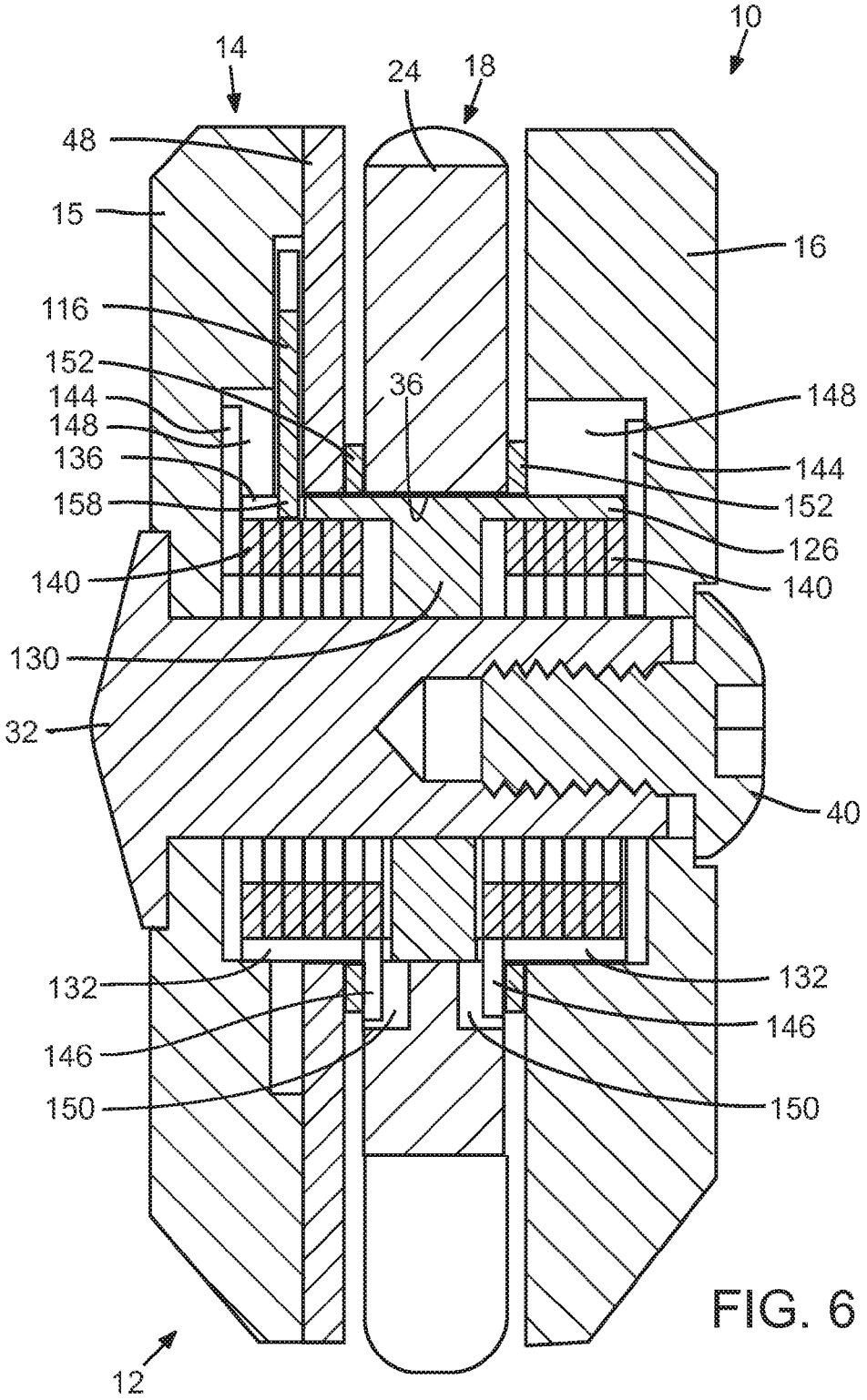
FIG. 6 is a cross sectional view taken along the line 6-6 of FIG. 4.

Folding knife 10 shown in FIG. 1 has an elongate handle 12 that is defined by separate handle halves 14 and 16, and a blade 18 that is pivotally attached between the handle halves at one end of the handle—referred to herein as the "forward" end 20 of the handle 12. Other relative directional terms correspond to this convention: the "rear" or butt end 22 of the handle 12 is opposite the forward end 20; the "upper" edge 24 of blade 18 is the dull, non-working portion and the "lower" edge 26 of blade 18 is the sharpened, working portion; "inner" or "inward" refers to the structural center of the knife, and so on. FIG. 5 shows knife 10 with the blade 18 in the open position and the components in an exploded view. It will be appreciated that when the components are assembled into a finished knife 10 as illustrated in FIGS. 1 through 4A, the handle halves 14 and 16 are attached to one another in a conventional manner (such as with plural screws 28) with the blade pivotally attached to the handle halves 14 and 16 with a blade pivot pin 30 that is defined by a cylindrical, internally threaded sleeve 32 that extends through a bore 34 in handle half 16, a pivot axis bore 36 in the tang of blade 18, and a bore 38 in handle half 14. A screw 40 threads into the internal threads of sleeve 32 to secure the blade 18 in a pivotal attachment to the handle 12. In the assembled knife 10, the handle halves 14 and 16 are held in a spaced apart relationship with spacers such as spacers 52 to define a blade-receiving groove 44 between the handle halves. The blade 18 is pivotally mounted so that the blade may be pivotally rotated about the blade pivot pin 30 between the open and closed positions as with a conventional knife.

As best seen in FIG. 5, annular shelves 150 are formed to extend partially around the circumference of pivot axis bore 36 of blade 18. Each annular shelf 150 (there is one on each side of blade 18, although only the annular shelf 150 is visible in the perspective view of FIG. 5) extends only partially around the circumference of the pivot axis bore 36, and thus each annular shelf defines a closed first end 160 and a closed second end 162. The annular shelves 150 extend between about 150 to 200 degrees around the circumference of the pivot axis bore and as seen in the view of FIG. 5, extend in the clockwise direction from about the 7:00 o'clock position to about the 2:00 o'clock position (analogizing the round axis pivot bore 36 to a clock face). The function of annular shelves 150 is detailed below.

An X-Y-Z axis grid is shown in FIG. 5. The X-Y plane is defined as the plane parallel to the plane defined by the handle 102 and blade 104—the blade travels in the X-Y plane as it is rotated between the closed and open positions. The Z plane is the plane transverse to the X-Y—the blade pivot pin 30 extends longitudinally in the Z-plane.

In the embodiment of FIG. 1, the handle half 14 shown in the near side in the view of FIG. 1 is defined by an outer sidewall 46 and a liner 48 positioned immediately adjacent and inwardly of the sidewall 46. An optional plate 50 is affixed to the outer surface of handle half 16 in FIG. 1.

Outer sidewall 46 of handle half 14 comprises three separate structures: a forward sidewall section 15, a rearward sidewall section 17, and a bolster 102 that is slidably retained between the forward and rearward sidewall sections.

As noted previously, the components of knife 10 are held together as an assembled knife with the combination of the blade pivot pin and with plural screws 28, which as best seen in the exploded view of FIG. 5 are threaded into spacers 52 that have internally threaded bores. The spacers are interposed between the handle halves 14 and 16 and maintain the spacing therebetween. Handle half 16 includes a lock 54 that is defined by a locking arm 56 cut into the handle half and normally biased inwardly toward blade receiving groove 44. Lock 54 is a conventional lock and is similar in most respects to the locking mechanism disclosed in U.S. Pat. No. 7,305,768, which is owned by the assignee of the present invention and the entire content of which is incorporated herein by this reference. Briefly summarized, the forward end 58 of the locking arm 56 interacts with and engages a locking surface 60 on the rearward-facing end of blade 18 when the blade is in the open position in order to lock the blade in the open position. With the blade in the open position, a blade open stop pin 62 that extends between handle halves 14 and 16 abuts a shoulder 64 on the blade to stop rotational travel of the blade in the fully opened position. The lock is released by pushing the locking arm 56 outwardly to disengage the forward end 58 from the locking surface 60, and rotating the blade about pivot pin 30 from open to closed.

Handle halves 14 and 16 may be fabricated from any suitable material such as metal, reinforced synthetic plastics, or other suitable materials such as carbon fiber, wood, etc., and combinations of these materials.

Blade 18 is attached to handle 12 such that the blade's working portion 66 extends away from the handle 12 when the blade is in its open position (FIG. 2), and tang portion 68 is located within the blade receiving groove 44 between the handle halves 14 and 16 when the blade is in either the open or the closed position. That is, the tang portion 68 is always located between the handle halves 14 and 16 of handle 12. A thumb lug 70 may be included on blade 18 to assist with opening and closing the blade, especially as detailed below with opening the blade when the knife 10 is being opened manually.

Blade open stop pin 62 has its opposite ends anchored in counter bored holes 72 (only one of which is shown in the view of FIG. 5) formed in handle halves 14 and 16 and is held in place with screws 74. As noted, the blade stop pin 62 functions to stop the rotation of blade 18 when the blade is in the fully open position as shown in FIG. 2. In this position, shoulder 64 on blade 18 makes contact with the blade stop pin 62 to stop rotation of the blade. Simultaneously when the blade reaches this rotational position, the forward end 58 of locking arm 56 snaps behind locking surface 60 of blade 18 to lock the blade open.

Having described knife 10 and its structural features in a general manner, the structures that provide the dual modalities of manual and automatic opening will now be described.

When the blade 18 of knife 10 is in the closed position, the blade may always be opened either manually or automatically. "Manual" opening refers to the user manipulating the blade to rotate it from the closed to the open position. On the other hand, "automatic" opening refers to the user firing a trigger so that the blade is driven under spring pressure from the closed to the open position. The components that provide the automatic opening functionality and modality are identified generally as switch mechanism 100. Switch mechanism 100 comprises plural components, the structure and operation of which are described below.

Figure 7:
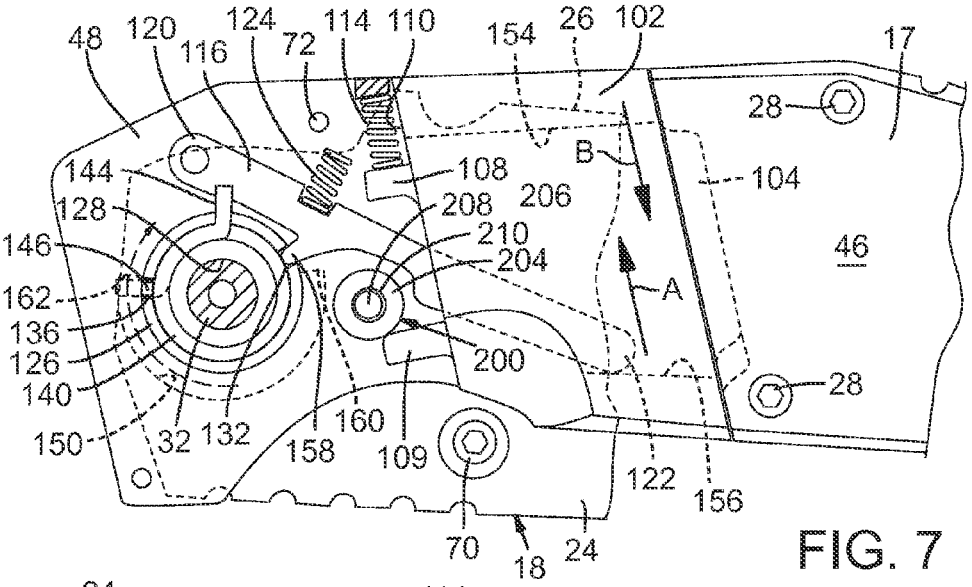
FIG. 7 is a side elevation and fragmentary view of a knife according to the present invention wherein portions of the near side handle have been removed to show internal structures, and showing the blade in the closed position.
Figure 8:
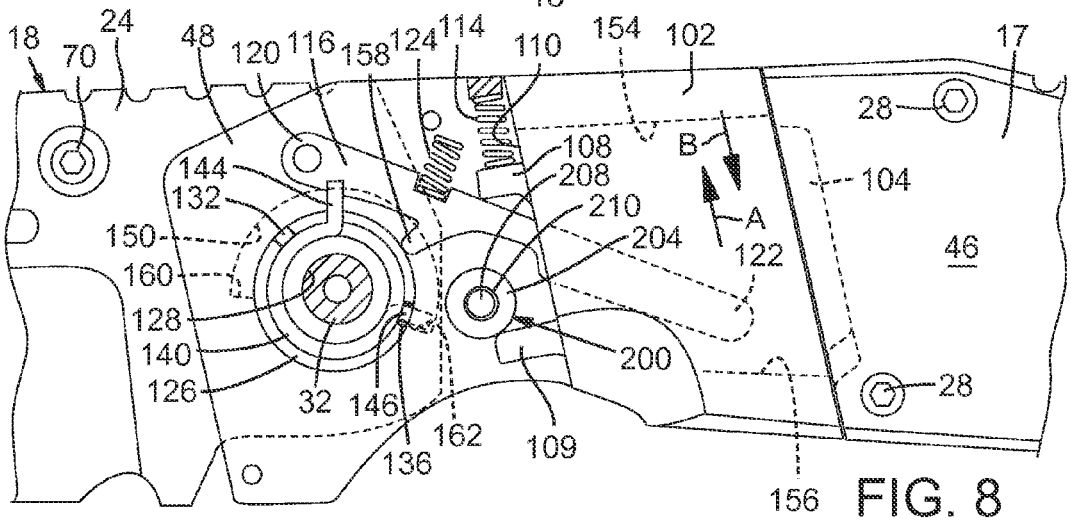
FIG. 8 a side elevation and fragmentary view of the knife shown in FIG. 7 with the blade in the open position and wherein the blade has been driven into the open position automatically.
Figure 9:
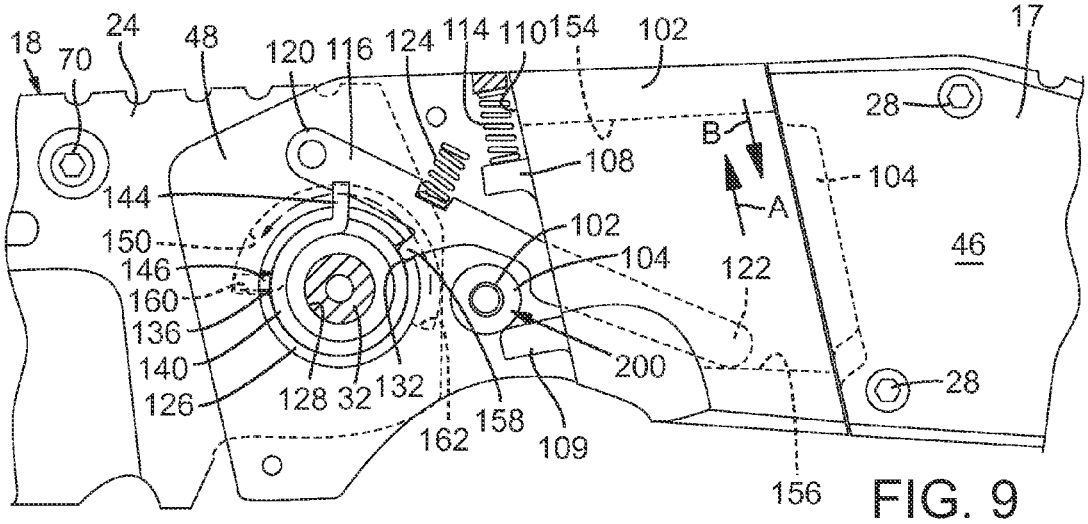
FIG. 9 is a side elevation and fragmentary view of the knife of FIG. 7 with the blade in the open position and wherein the bade has been opened manually.

With reference to FIG. 5, switch mechanism 100 utilizes a bolster 102 that is reciprocally slidably retained in handle halve 14 between forward sidewall section 15 and rearward sidewall section 17 so that the bolster may be moved in an up and down motion (generally along the X axis and transverse to the longitudinal axis (Y) defined by handle 12) relative to the handle half 14. As shown in FIGS. 7, 8 and 9, the bolster 102 may be angularly slidable in handle half 14, although the bolster still reciprocates generally in the X direction. Bolster 102 is retained in handle half 14 with a tab 104 that extends from the rearward lateral edge 106 of the bolster, and a tab 108 extending from the forward lateral edge 110 of the bolster. Tab 104 is received in a slot cooperatively formed in the mating portion of rearward sidewall section 17 of handle half 14 (not visible in FIG. 5). Tab 108 is received in a cavity 112 cooperatively formed in the forward sidewall section 15 of the handle half 14. Both the slot and cavity just mentioned are larger than the respective tabs to allow for reciprocal motion of bolster 102 over a limited travel distance. As seen in FIGS. 7, 8 and 9, bolster 102 also includes a lower, forwardly extending arm 109, the function of which is described below.

The home position of bolster 102 is the position shown in FIG. 1—that is, where the bolster is normally positioned in handle half 14. The bolster is maintained in this position by a spring 114 that is received in cavity 112 between the upper surface of tab 108 and the upper surface of the cavity, so that the spring pushes downwardly on tab 108 (arrow B, FIG. 7). A second spring, which is not shown, resides in the slot in the rearward sidewall section 17 of handle 14 and this second spring acts in concert with the first spring 114 and helps prevent rotational binding of the bolster 102 as it is moved. Bolster 102 may be moved upwardly, arrow A, FIG. 7, by the user sliding the bolster upwardly against the opposing spring pressure applied to the bolster by spring 114. As detailed below, moving the bolster from its home position upwardly is the actuating or triggering mechanism that causes the blade to open automatically.

In addition to the bolster 102, the switch mechanism 100 further comprises a lever 116 having its first end 118 pivotally connected between the respective facing surfaces of forward sidewall section 15 of handle half 14 and liner 48 with a pin 120. The opposite, second end 122 of lever 116 is a free end that is movable generally in the direction of the X axis—the second, free end 122 of the lever is movable as the lever 116 pivots about pin 120. A spring 124 is retained in handle half 14 between the handle and the liner 48 and applies pressure continuously to lever 116 in the downward direction of arrow B.

Figure 15:
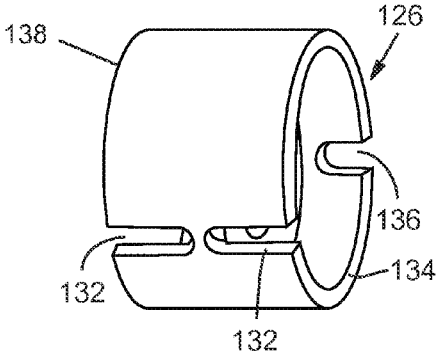
FIG. 15 is a perspective view of the pivot shaft bushing used with the knife according to the present invention, illustrating the bushing in isolation without other structures.
Figure 13:
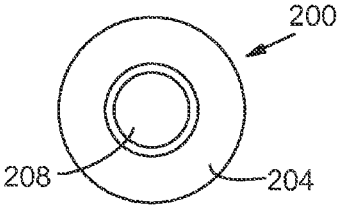
FIG. 13 is an end view of the safety interlock pin of FIG. 12.
Figure 14:
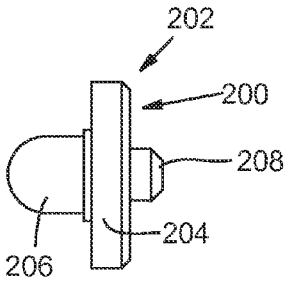
FIG. 14 is a side elevation view of the safety interlock pin of FIG. 12.
Figure 16:
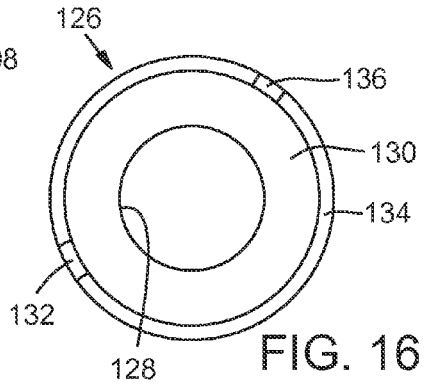
FIG. 16 is an end view of the bushing of FIG. 15.
Figure 17A:
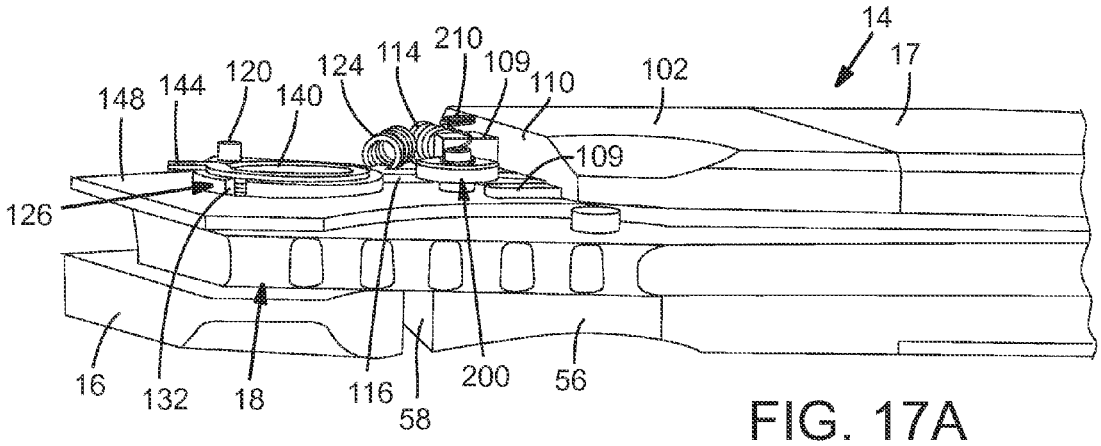
FIG. 17A is a perspective and fragmentary view of the knife of the present invention with some structures removed in order to expose components of the knife.
Figure 17B:
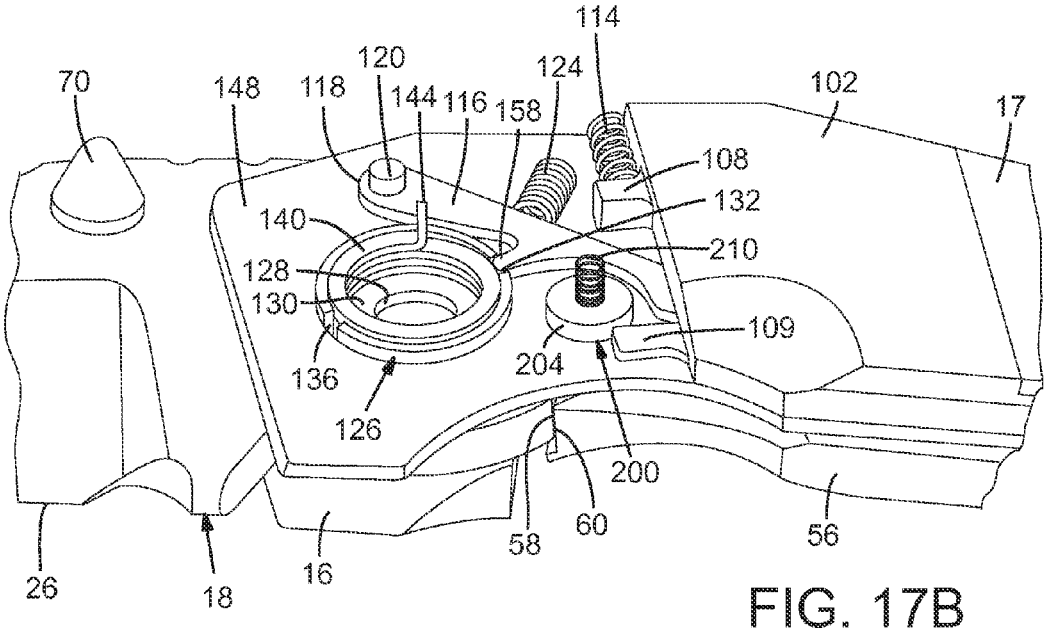
FIG. 17B is a perspective view similar to FIG. 17A except showing the blade in the open position, the blade having been opened manually.

As best seen in FIGS. 15 and 16, a bushing or sleeve 126 extends through pivot axis bore 36 in the tang of blade 18 and is axially rotatable in the bore. The sleeve 32 of blade pivot pin 30 extends through the central opening 128 of the sleeve 126 (FIG. 16). The diameter of the central opening 128 of the sleeve 126 is reduced by an annular lip 130 in the sleeve 126. The diameter of opening 128 is the same as or slightly more than the diameter of sleeve 32 so that the blade 18 is readily pivotal; as noted, bushing 126 is axially rotatable relative to the handle 12, as well. Notches are formed in sleeve 126 to interact with torsion springs that drive the automatic opening of blade 18. Specifically, a pair of first notches 132 is formed opposite one another on annular edges 134 and 138 of sleeve 126. A second notch 136 is formed in annular edge 134, opposite from the notch 132 formed in the same annular edge.

Two torsion springs 140 are received in the interior of sleeve 126 on opposite sides of the annular lip 130 with the blade pivot pin 30 extending through the central openings of the springs. Each spring 140 has a first leg 144 and a second leg 146. —the first legs are the outermost legs and these legs are fixed in notches 148 in the handle halves (FIG. 5—only the notch 148 in handle half 16 is visible in the view of FIG. 5). The second legs 146 of each spring 140 extends through the respective notches 132 in sleeve 126 and, in the assembled knife 10, reside in and interact with the annular shelves 150 formed in the tang 68 of blade 18 around pivot axis bore 36. Washers 152 may be utilized between the outer annular edges 134 and 138 of sleeve 126 and the respective handle halves.

The interior surface of bolster 102 has a cavity 154 formed therein in which lever 116 resides. The lower edge 156 of cavity 154 makes contact with the second end 122 of lever 116 (i.e., the free end) as the bolster 102 is moved reciprocally in the directions of arrows A and B to cause the lever to pivot about pin 120, for instance, as seen in FIG. 7.

A hook or thumb 158 is formed on lever 116 about midway along the length of the lever; the thumb 158 extends downwardly from the lever. As detailed below, thumb 158 is positioned to engage (and disengage) from notch 136 in sleeve 126 and functions as a stop that when engaged to the sleeve 126 prevents the sleeve from rotating.

Continuing with a description of the components of knife 10, the knife includes a safety mechanism that prevents dry firing of the automatic opening mechanisms when the blade has been opened manually. The dry fire safety, referenced generally at 200 is defined by a mechanism that extends through portions of the body of the knife and which is activated by movement of the blade from the closed to the open position—the blade when moved to closed moves the safety mechanism to the "off" position. When the blade is moved into the open position, the tang of the blade is able to clear the safety mechanism and the safety is thus in the "on" position. It should be noted that the dry fire safety 200 is operable to prevent firing of the automatic opening mechanism 100 when the blade has been opened manually, and this to prevent damage that could occur if the mechanism 100 were fired with the blade already open.

Figure 10:
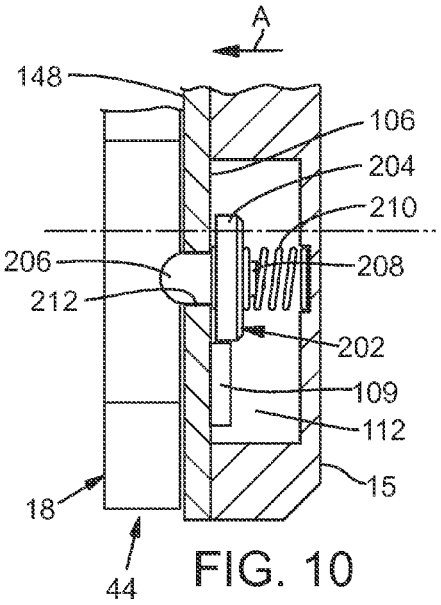
FIG. 10 is a partial sectional and close up view of a safety interlock pin used in the present invention.
Figure 11:
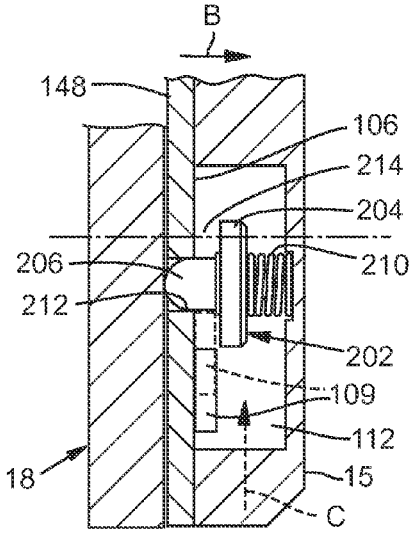
FIG. 11 is a partial sectional view similar to FIG. 10 of the safety interlock pin, but in FIG. 11 the blade is in the closed position and is ready to be opened either automatically or manually.
Figure 12:
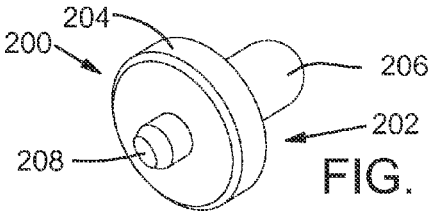
FIG. 12 is a perspective view of the safety interlock pin shown in isolation without other structures.

Dry fire safety 200 utilizes a button 202 that is defined by a disk-shaped base 204 with an arm 206 extending from one side of the disk and a relatively smaller arm 208 extending from the opposite side of the disk. The outer end of arm 206 is rounded. Button 202 is shown in isolation in FIGS. 12, 13 and 14, and the dry fire safety 200 is assembled into handle 12 as seen in the exploded view of FIG. 5, and the partial sectional views of FIGS. 10 and 11. With reference to FIGS. 10 and 11, button 202 is retained in cavity 112 of forward sidewall section 15 of handle half 14 with a coil spring 210 having one end encircling smaller arm 208 and its opposite end bearing against the interior facing wall of cavity 112. The relatively longer arm 206 extends into and through a bore 212 formed in liner 48 and spring 210 thus urges button 202 in the direction of arrow A in FIG. 10. In the resting or home position shown in FIG. 10, disk 204 is pressed against liner 48 and the outermost, rounded end of arm 206 extends through the liner and is interposed in the blade receiving groove 44 in a position such that the end of the arm 206 interacts with the blade 18 in some circumstances, detailed below, as the blade moves from the open to closed.

Having described the structure of the components of knife 10 and the manner in which the components are assembled, operation of the knife will now be detailed. As noted, the knife 10 according to the invention is always operable in two different modes when the blade 18 is in the closed position: (a) a manual mode in which the blade 18 is movable from the closed to the open position, and from the open to the closed position, by manual manipulation of the blade by the user; and (b) an automatic mode in which the blade 18 is automatically driven from the closed position when the user activates a trigger (defined by bolster 102 and switch mechanism 100 generally). When the blade has been opened automatically, it is moved from the open position to the closed position by the user manually folding the blade back into the handle; but in this case when the user rotates the blade from open to closed, the rotation of the blade winds the springs that are used in the automatic firing mechanism.

Regardless of how the blade is moved to the open position—either in the manual or automatic modes—the lock 54 locks the blade in the open position. Specifically, as best seen in FIG. 3, with the blade in the open position the lock arm 56 is urged inwardly under the normal bias of the lock arm so that the forward end 58 of the lock arm is abutting the locking surface 60 on the tang portion 68 of blade 18. It will be appreciated that it is always necessary to unlock the lock 54 to move the blade from the locked open position (FIG. 3) to the closed position (FIG. 4A). The lock 54 is unlocked by moving lock arm 56 outwardly, away from the blade receiving groove 44 to disengage the forward end 58 from the locking surface 60. Once the forward end 58 is disengaged from locking surface 60 the blade 18 may be rotated (manually) toward the closed position.

When knife 10 is assembled, the first legs 144 of springs 140 are received in the notches 148 in the respective handles 14 and 16. The main bodies of the springs 140 are received in the sleeve 126, one spring 140 on each side the annular lip 130 and on opposite sides of the blade 18 (FIG. 5), with the first legs 144 extending into the notches 148 in the handles so that the first legs 144 of the springs 140 are fixed relative to the respective handle halves. The second legs 146 of springs 140 extend through notches 132 in sleeve 126 (again, one spring on each side of the blade) and the second legs 146 extend into the annular shelves 150 that are formed around the pivot bore 136 through blade 18. When the knife 10 is assembled, the springs 140 are installed in a wound condition. As such, when for example the knife blade 18 has been opened automatically, the second legs 146 of each of the springs 140 bear against the closed second ends 162 of the annular shelves 150, continuously urging the blade to the open position (arrow C, FIG. 7) and so that the shoulder 64 on the blade abuts the blade stop pin 62 (the stopped open position). In the stopped open position, lock 54 is in the locking position described earlier and the blade is locked open.

Reference is now made to FIGS. 7 and 11, both of which illustrate blade 18 in the closed position and knife 10 ready to be opened either manually or automatically, according to the user's choice. In this position, with blade 18 closed, the blade is in contact with the rounded outer end of arm 206 of dry fire safety 200. Thus, as the blade rotates from open to closed the blade pushes the button 202 inwardly (arrow B, FIG. 11) into the cavity 112 so that the disk 204 of button 202 is spaced away from the liner to create a gap 214 between the disk 204 and the liner 148. When bolster 102 is in its home or resting position (FIGS. 1 through 4A, for example) lower arm 109 that is a part of bolster 102 extends to a point immediately below the periphery of disk 204. The width of gap 214 is slightly greater than the thickness of lower arm 109 and accordingly, the lower arm 109 is able to slide into the gap 214 between the liner 48 and the disk 204. As detailed below, the presence of the gap 214 allows movement of bolster 102 (arrow C, FIG. 11).

On the other hand, as shown in FIG. 10, which illustrates the blade 18 in the open position (having been opened manually), the arm 206 of button 202 is no longer in contact with blade 18 because with the blade in the open position the arm 206 is behind the rearward edge of the blade (as defined by shoulder 64). Because there is no interference between the arm 206 and the blade, the button 202 is urged under spring pressure from spring 210 to the point where disk 204 lies flush against liner 148, eliminating the gap 214 between the disk and the liner. Because there is no gap, disk 204 directly blocks lower arm 109 and thus prevents bolster 102 from moving. As detailed below, this prevents "dry firing" of the automatic opening mechanism when the blade 18 is in the open position and having been opened manually.

With returning reference to FIG. 7, blade 18 is in the closed position and knife 10 is ready to be opened either manually or automatically.

Manual opening is accomplished by the user manipulating the blade, with for example thumb lug 70, to the open position where shoulder 64 abuts stop pin 62 and lock 54 locks the blade open. This is the position shown in FIG. 9. In this position, bolster 102 and lever 116 are in their home positions, the bolster retained in this position under spring pressure from spring 114 and the lever retained in this position under spring pressure from spring 124. In this home position, the free end 122 of lever 116 is pressed against the lower edge 156 of cavity 154 in bolster 102 and the thumb 158 on lever 116 is extending into notch 136 on sleeve 126. In this position the springs 140 are wound tightly but the second legs 146 of the springs are not exerting any rotational pressure on blade 18 because the second legs are not bearing against the closed second ends 162 of annular shelves 150. Instead, because the thumb 158 is engaged in notch 136 and acts as a lock or stop that prevents the sleeve 126 and the second legs 146 of springs 140 from rotating; as the blade rotates from closed to open the second legs 146 simply ride in the annular shelves 150 during rotation. As detailed above, the dry fire safety 200 prevents bolster 102 from moving so the automatic opening mechanism cannot be fired.

Referring now to FIG. 8, automatic opening is accomplished only with blade 18 in the closed position, and by the user activating the trigger defined by bolster 102. Recall that as shown in FIG. 11 with blade 18 in the closed position, the dry fire safety 200 is in the "off" position and the gap 214 is present between disk 204 and liner 148. In this safety-off position, the trigger mechanism is activated by sliding bolster 102 upwardly in the direction of arrow A, FIG. 7. As the bolster slides upwardly, the lower edge 156 of cavity 154 pushes on free end 122 of lever 116, causing the lever to pivot about pin 120 so that the free end moves in the direction of arrow A. As the lever thus moves, thumb 158 disengages from notch 136 in sleeve 126. The instant that the thumb 158 is disengaged from notch 136, both of the springs 140 are free to unwind (arrow C, FIG. 7); the second legs 146 bear against the respective closed second ends 162 of the annular shelves 150 around the pivot bore 36 as the springs unwind, thus causing the blade to move rapidly and automatically from the closed to the open position, where the blade is locked open as described earlier. The sleeve 126 also rotates with as the springs unwind, since the second legs 146 extend through the notches 132 in the sleeve. Once the blade is in the open position, bolster 102 may be released and spring 114 pushes the bolster back to its home position as shown in FIG. 8. However, because sleeve 126 has rotated when the blade 18 rotated during the opening movement, thumb 158 of lever 116 rests against the outer surface of the sleeve. When bolster 102 returns to its home position and the blade 18 is in the open position, dry fire safety 200 returns to the safety-on position shown in FIG. 10.

Having been opened automatically, blade 18 is moved from the open position to the closed position by unlocking lock 54 and rotating the blade. As the blade rotates, second legs 146 of springs 140 are rewound because the legs are pressed against the closed second ends 162 of the annular shelves 150 and sleeve 126 rotates with the blade. Thumb 158 rides over the outer surface of sleeve 126 until rotation of the blade and sleeve reaches the point where the thumb 158 overlies notch 136. At this point, the thumb again enters the notch, having been pushed into the notch by virtue of the spring pressure applied to lever 116 by spring 124. At this point, and in this position, the automatic opening mechanism is reloaded and the knife has again been readied for opening in either the manual or automatic modes (FIG. 7).

It will be appreciated that certain modifications to the structures of the invention described above may be made without changing the scope of the invention. As one example, the knife 10 may be embodied with only a single torsion spring 140 rather than the dual spring embodiment described above. As another example of a modification of the invention, the arcuate length of the annular shelves 150 may be varied and the position of the shelves on the tang of the blade may be varied. For instance, in the embodiment shown in the drawings and particularly the drawing of FIG. 5, the shelves 150 extend from about the 7:00 to the 2:00 o'clock positions. The shelves may just as functionally be formed at other positions, with appropriate modifications to other structures affected by the position of the shelves.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. A folding knife having a handle with opposed first and second halves held in a spaced apart relationship with a slot therebetween, and a blade pivotally connected to the handle between the handles halves with a pivot shaft extending through a bore in the blade so the blade is movable about the pivot shaft between a closed position and an open position, the improvement comprising:

a sleeve extending through and rotatable in said bore, said sleeve having a first notch and a second notch;

a spring around the pivot shaft and retained in said sleeve, said spring having a first leg fixed to a handle half and a second leg extending through the first notch in said sleeve so that said second leg engages said blade;

a sleeve stop pivotally movable between a first position in which said sleeve stop engages said second notch to prevent rotation of said sleeve and a second position in which said sleeve stop disengages from the second notch to allow rotation of the sleeve;

a bolster movable between first and second positions, said bolster operable to pivotally move the sleeve stop between its first and second positions.

2. The folding knife according to claim 1 wherein said blade is movable from the closed position to the open position both manually and automatically.

3. The folding knife according to claim 2 wherein said blade is moved from the closed position to the open position when said trigger is in the second position.

4. The folding knife according to claim 1 including a safety movable between safety on and safety off positions, said safety including a member that prevents movement of said trigger from its first to second positions when the safety is in the safety on position and said blade is in the open position, and allowing movement of the trigger from its first to second positions when the safety is in the safety off position and said blade is in the closed position.

5. The folding knife according to claim 4 in which said safety is moved from the safety on position to the safety off position by movement of the blade from its open position to its closed position.

6. A folding knife, comprising, a handle defined by first and second handle halves held in a spaced apart relationship to define a blade groove therebetween;

a blade pivotally connected between the handle halves with a pivot shaft extending through a bore in a tang portion of the blade so that the blade is movable in a rotational path between an open position and closed position;

a sleeve extending through the bore in the tang, said sleeve having a notch therein;

a spring around the pivot shaft and retained in the sleeve, said spring having a first leg fixed relative to the handle and a second leg;

a trigger in one of said handle halves movable between first and second positions, said trigger having a cavity formed on an interior portion thereof facing said blade groove;

a lever having a first end attached to the handle, a second free end in the cavity and a hook between the first and second ends;

wherein movement of the trigger from the first to the second position causes movement of the lever from a first position in which said hook is engaged with said notch in said sleeve to a second position in which said hook is disengaged from said notch in said sleeve.

7. The folding knife according to claim 6 wherein said blade may be moved from the closed position to the open position both manually and automatically.

8. The folding knife according to claim 7 wherein said blade may be moved from the closed position to the open position manually when said hook is engaged with said notch.

9. The folding knife according to claim 7 wherein said blade is moved from the closed position to the open position automatically when said hook is disengaged from said notch.

10. The folding knife according to claim 9 including an annular shelf formed partially around the bore in the tang of the blade, said annular shelf having a closed end, and wherein said second leg of said spring extends into said annular shelf.

11. The folding knife according to claim 10 wherein said second leg of said spring exerts pressure against the closed end of said annular shelf when said hook is disengaged from said notch to thereby automatically move the blade from the closed position to the open position.

12. The folding knife according to claim 6 including a safety movable between safety on and safety off positions, said safety blocking movement of said trigger from its first to second positions in the safety on position and allowing movement of the trigger from its first to second positions in the safety off position.

13. The folding knife according to claim 12 wherein said safety is in the safety on position when said blade is in its open position.

14. The folding knife according to claim 13 in which said safety is moved from the safety on position to the safety off position by movement of the blade from its open position to its closed position.

15. A folding knife, comprising, a handle defined by first and second handle halves held in a spaced apart relationship to define a blade groove therebetween;

a blade pivotally connected between the handle halves with a pivot shaft extending through a bore in a tang portion of the blade so that the blade is movable in a rotational path between an open position and closed position, said blade having first and second sides and a first annular shelf formed partially around the bore on the first side of said blade and a second annular shelf formed partially around the bore on the second side of said blade, both of said annular shelves having a closed end;

a sleeve extending through the bore in the tang, said sleeve having a notch therein;

a first spring around the pivot shaft and retained in the sleeve on the first side of said blade, said first spring having a first leg fixed relative to the handle and a second leg extending into the first annular shelf;

a second spring around the pivot shaft and retained in the sleeve on the second side of said blade, said second spring having a first leg fixed relative to the handle and a second leg extending into the second annular shelf a trigger in one of said handle halves movable between first and second positions, said trigger having a cavity formed on an interior portion thereof;

a lever having a first end attached to the handle, a second free end in the cavity and a hook;

wherein movement of the trigger from the first to the second position causes movement of the lever from a first position in which said hook is engaged with said notch in said sleeve and a second position in which said hook is disengaged from said notch in said sleeve and wherein when said hook is disengaged from said notch, said springs apply pressure to the closed ends of said annular shelves to drive the blade from the closed position to the open position.

16. The folding knife according to claim 15 in which when the trigger is in the first position and the lever is in the first position, the blade may be moved from the closed position to the open position either manually or automatically.

17. The folding knife according to claim 16 further comprising a safety having an arm that stops movement of the trigger from the first position to the second position when the blade is in the open position and the blade has been opened manually.

18. The folding knife according to claim 16 wherein when the blade is moved from the open position to the closed position the blade moves the safety to a safety off position in which the blade may be opened automatically.

19. The folding knife according to claim 15 wherein said sleeve rotates when said hook is disengaged from said notch in said sleeve.

20. The folding knife according to claim 19 including a lock to lock the blade in the open position.

* * * * *